US006321678B1

(12) United States Patent
Skulnick

(10) Patent No.: US 6,321,678 B1
(45) Date of Patent: Nov. 27, 2001

(54) INFLATABLE DINGY CHOCK

(76) Inventor: Steve Skulnick, P.O. Box 2546, Ramona, CA (US) 92065

( * ) Notice: Subject to any disclaimer, the term of this patent is extended or adjusted under 35 U.S.C. 154(b) by 0 days.

(21) Appl. No.: 09/729,175

(22) Filed: Dec. 5, 2000

(51) Int. Cl.[7] ..... B63B 23/64
(52) U.S. Cl. ..... 114/381
(58) Field of Search ..... 405/7; 114/381, 114/258, 259, 365

(56) References Cited

U.S. PATENT DOCUMENTS 1,321,746 11/1919 Hunkeler .
2,962,732 12/1960 Marz .
3,721,096 * 3/1973 Deckert, Jr. et al. ..... 405/7
4,243,239 1/1981 Whitney .
4,495,880 1/1985 Maniscalco et al. .
4,895,096 1/1990 Goodwin et al. .
5,222,454 * 6/1993 Meyer ..... 114/259
5,884,885 * 3/1999 Schmidt, Jr. ..... 248/346.01

* cited by examiner

*Primary Examiner*—Ed Swinehart
(74) *Attorney, Agent, or Firm*—Nixon & Vanderhye P.C.

(57) ABSTRACT

A system for mounting a dingy on a deck or platform of a boat is provided. At least one selectively inflatable dingy chock is mounted on the deck or platform of the boat in order to support a dingy thereon. When the dingy is removed for use, the chock(s) may be deflated for efficient and convenient storage. Alternatively, inflatable chocks herein may be used to support jet-skis on boat surface(s)/platform(s).

6 Claims, 2 Drawing Sheets

INFLATABLE DINGY CHOCK

This invention relates to an inflatable dingy chock, and/or a method of supporting/mounting a dingy on a boat using at least one inflatable dingy chock.

BACKGROUND OF THE INVENTION

Cabin cruisers, yachts, and similar boats often have a dingy mounted thereon. A dingy is typically from about 5–14 feet in length, and may be inflatable. Alternatively, other dingies may be made of fiberglass, metal, or any other suitable material. Dingies are typically mounted on either the deck or swim platform of such boats. Dingies are often used as emergency life rafts/boats, or alternatively to enable boaters to anchor a distance from shore in their large boat and move ashore on their dingy.

In order to secure a dingy on a deck or platform of a boat, dingy "chocks" are typically provided. For example, U.S. Pat. No. 4,895,096, the disclosure of which is hereby incorporated herein by reference, discloses a dingy mounted on the deck of a boat via a plurality of dingy chocks. In this regard, reference is made to FIG. 1 of the instant application. As shown in prior art FIG. 1, dingy 2 is mounted on deck 1 of a boat by way of four dingy chocks 3. Chocks 3 are typically of fiberglass, wood, or other solid material. Other dingy mounting systems are also known (e.g., where chocks are mounted on the swim platform of a boat).

Unfortunately, in many prior art applications, dingy chocks are semi-permanently mounted to the deck or swim platform of a boat. Thus, when the dingy is taken off of the chocks for use, the chocks often remain on the deck or platform thereby creating a significant obstruction to free use of the same. In scenarios where solid dingy chocks may be removed from the deck or platform, such chocks typically take up substantially amounts of space and are difficult to store in a convenient manner. As will be appreciated by those skilled in the art, space is very valuable on a boat.

In view of the above, it will be apparent to those skilled in the art that there exists a need for an improved dingy chock(s) for supporting a dingy on the deck or platform of a boat.

SUMMARY OF THE INVENTION

An object of this invention is to provide an inflatable dingy chock(s).

Another object of this invention is to provide a dingy chock(s) which may be selectively inflated and/or deflated. When inflated, the chock may be mounted on a deck or platform of a boat in order to support a corresponding dingy. When the dingy is removed for use, the chock(s) may be deflated and easily stored in a convenient manner.

Certain embodiments of this invention fulfill one or more of the above-listed objects and/or needs by providing a structure for supporting a dingy on a boat, the structure comprising:

at least one inflatable dingy chock which is selectively inflatable and selectively deflatable, wherein said chock is adapted to be mounted on a deck or platform of the boat.

Other embodiments of this invention fulfill one or more of the above listed needs and/or objects by providing a method of supporting a dingy on a surface of a boat, the method comprising:

providing a dingy to be supported;

providing a boat;

inflating at least one dingy chock;

mounting the dingy chock on the surface of the boat; and mounting the dingy on at least an upper surface of the inflated chock so that the chock helps support the dingy on the boat.

IN THE DRAWINGS

DETAILED DESCRIPTION OF CERTAIN EMBODIMENTS OF THIS INVENTION

Figure 1:
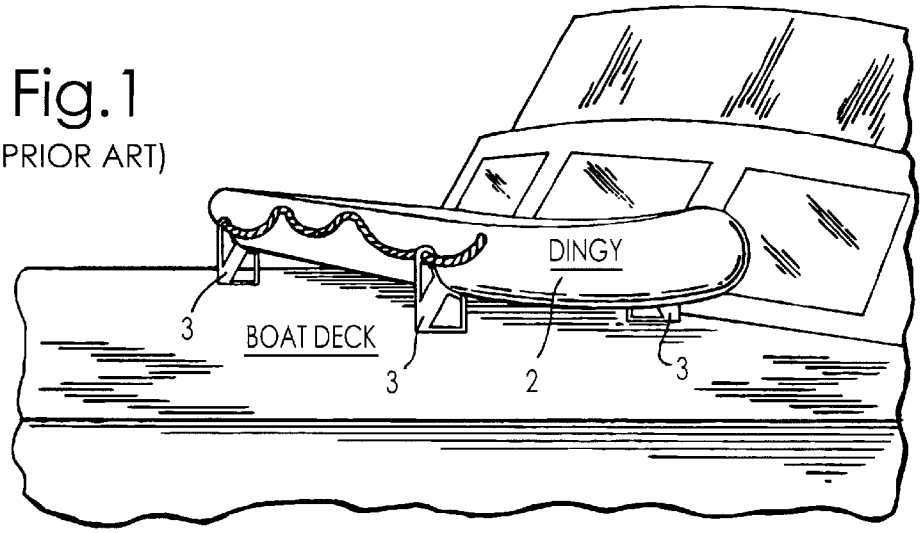
Fig.1 (PRIOR ART)
FIG. 1 is a prior art perspective view of a plurality of solid dingy chocks being used to support a dingy on a deck of a boat.

Referring now more particularly to the accompanying drawings, in which like reference numerals indicate like parts throughout the several views.

Figure 2:
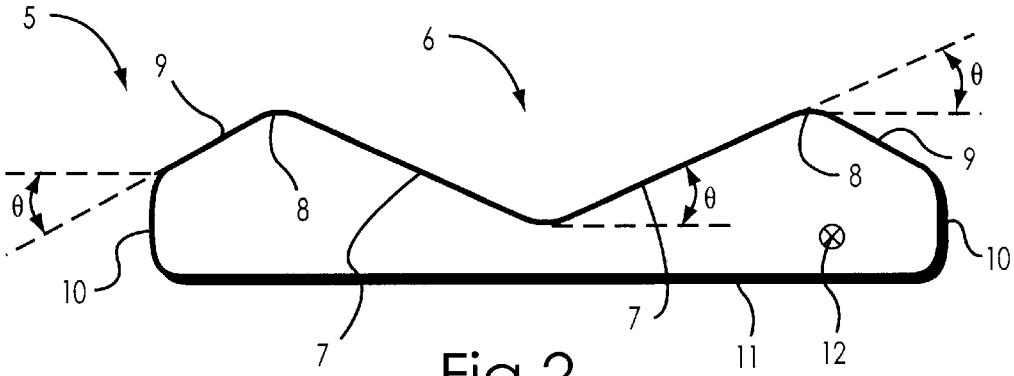
FIG. 2 is a front elevation view of an inflatable dingy chock in an inflated state according to an embodiment of this invention.

FIG. 2 is a front elevation view of inflatable dingy chock 5 in an inflated state. One or more of such chocks may be used to support a dingy on the deck or swim platform of a boat. As illustrated, inflated dingy chock 5 includes base wall 11, a pair of end or side walls 10, first and second converging angled walls 7 which form a substantially V-shaped or U-shaped channel 6 in a top surface of the inflated dingy chock, first and second respective apex or pinnacle portions 8 proximate respective ends 10 of the dingy chock 5, and a pair of angled walls 9 angled downwardly from pinnacle portions 8 to end walls 10. One or more aperture(s) or hole(s) 12 is provided in the body of the chock in order to enable air to be pumped into or let out of the body. In other words, aperture(s) 12 is selectively opened and closed to enable the chock to be selectively inflated and deflated via the same. The upper surface of dingy chock 5 (including walls 7 and 9, as well as channel 6 and pinnacles 8) is shaped in order to accommodate the bottom surface of a corresponding dingy 2 to be supported. Thus, the upper surface of dingy chock 5 may be of any suitable shape depending upon the shape of the hull of the dingy 2 to be supported. The shape shown in FIG. 2 if for purposes of example only, and is not intended to be limiting. Moreover, any suitable material may be used to form chocks 5 including material used in forming inflatable rafts and/or inflatable dingies.

In the embodiment of FIG. 2, angled walls 7 formed an angle $\theta$ of from about 15–70° with the horizontal, more preferably from about 20–50°, and most preferably from about 25–45°. Also, outer angled walls 9 formed an angle $\phi$ of from about 20–80° with the horizontal, more preferably from about 30–70°, and most preferably from about 35–60°.

Figure 3:
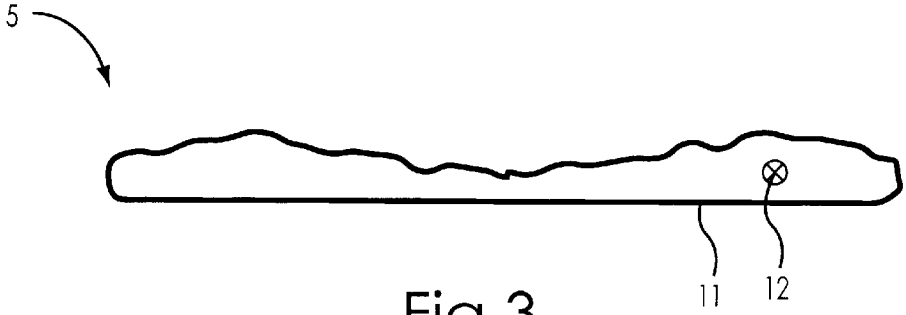
FIG. 3 is a front elevation view of the dingy chock of FIG. 2 in a deflated state.

FIG. 3 illustrates the inflatable dingy chock 5 of FIG. 2 in a substantially deflated state where the air has been let out of the chock. Thus, it can be seen that when a dingy 2 is removed from one or more chocks 5 for use, the chocks 5 may be easily deflated and efficiently/conveniently stored on the boat or at any other suitable location.

Figure 4:
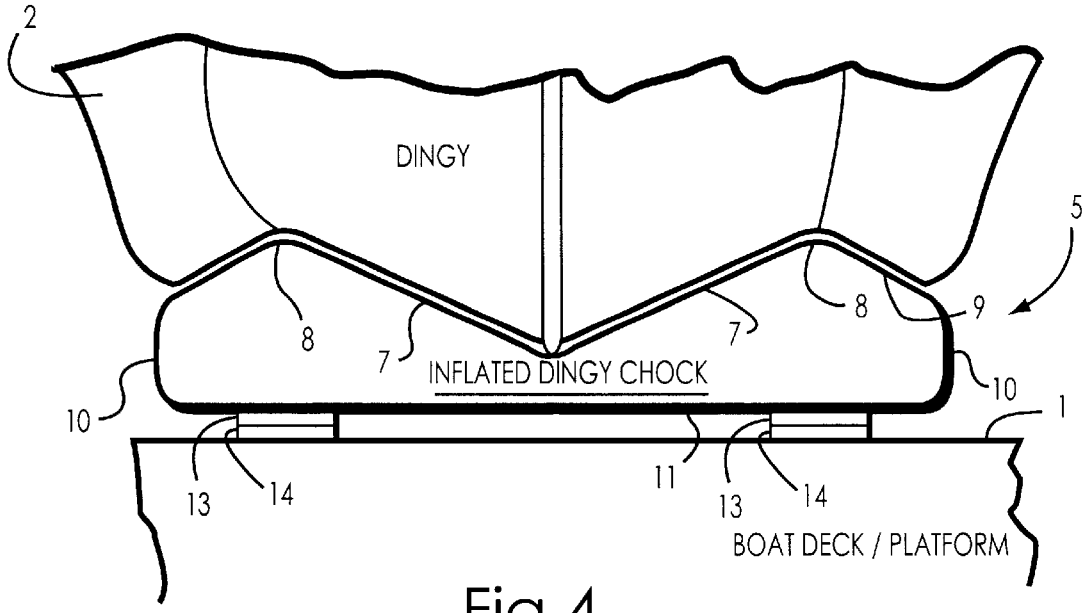
FIG. 4 is a front elevation view illustrating the inflated dingy chock of FIG. 2 mounted on the deck or platform of a boat in supporting at least a portion of a dingy.

FIG. 4 is a front elevation view of the inflated dingy chock 5 of FIG. 2 mounted on the deck or platform 1 of a boat. Chock 5 is secured to the upper surface of deck or platform 1 via one or more fastening members such as male 13 and female 14 Velcro (i.e., hook and loop) fastening members. For example, female Velcro portions 14 may be glued or otherwise secured to the boat deck or platform 1, while male Velcro portions 13 may be glued, stitched, or otherwise secured to the bottom wall 11 of chock 5. Thus, chock 5 may be easily mounted and selectively removed from the deck or platform 1 of the boat. Alternatively, instead of Velcro, any other suitable fastening system (e.g., snaps) may be used to secure the chock(s) to the boat deck or platform.

Furthermore, it can from FIG. 4 that the upper surface of chock 5 is shaped in accordance with the lower surface or hull of dingy 2. Thus, when different shaped dingies are to be mounted on a boat, corresponding different shapes of inflated dingy chocks 5 may be used.

Figure 5:
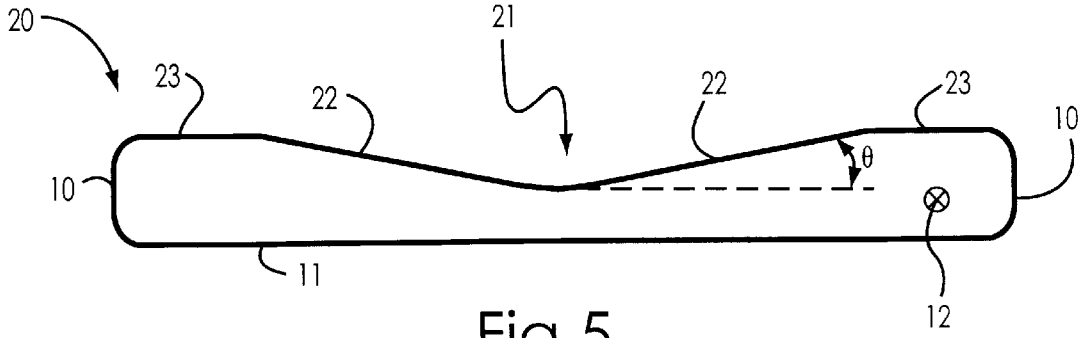
FIG. 5 is a front elevation view of an inflatable dingy chock in an inflated state according to another embodiment of this invention.

FIG. 5 is a front elevation view of an inflatable dingy chock 20 according to another embodiment of this invention. In an exemplary embodiment, the inflatable dingy chock 5 of FIGS. 2–4 may be used to support the front portion of a dingy while simultaneously the inflated dingy chock 20 of FIG. 5 may be used to support the rear or stern portion of the same dingy on the same boat deck or platform 1. This is because the front portion of the dingy hull may be shaped differently than the rear portion thereof. In other embodiments of this invention, a pair of dingy chocks 5 may be used to support the same dingy, or alternatively for different shaped dingies, a pair of chocks 20 may be used.

Referring again to FIG. 5, inflated dingy chock 20 includes base wall 11, end walls 10, plateau walls 23 which are approximately parallel to base wall 11, and depression shaped channel 21 formed by first and second converging angled walls 22. Each of angled walls 22 forms an angle $\theta$ of from about 5–40° with the horizontal, more preferably from about 10–35°. Chock 20 is selectively inflatable and deflatable in a manner similar to chock 5 as discussed above.

While inflatable chocks are used as dingy support chocks in embodiments described above, those skilled in the art will recognized that this invention is not so limited. For example, inflatable chocks as illustrated herein may also/instead be used as jet-ski support chocks so as to support jet-skis (instead of dingies) on boat decks/platforms in other embodiments of this invention.

In view of the foregoing, it will be apparent to those skilled in the art that the illustrated and described dingy chocks are provided for purposes of example only. Other shapes may be utilized. Additionally, according to another embodiment of this invention it is possible to have an inflatable dingy chock(s) 5, 20 permanently mounted to the bottom of a corresponding inflatable dingy (in such an embodiment, the inflatable dingy chock may be stitched to the bottom surface of the dingy).

What is claimed is:

1. A structure including at least one inflatable dingy chock supporting a dingy on a boat, the structure comprising:

at least one inflatable dingy chock which is selectively inflatable and selectively deflatable, wherein said chock is mounted on a deck or platform of the boat; and wherein said inflatable dingy chock extends substantially all the way across a bottom of a hull of the boat, and wherein said chock includes an approximately V-shaped or U-shaped channel defined in an upper surface thereof for receiving a bottom central portion of said hull in a supporting manner.

2. The structure of claim 1, wherein said chock has an upper surface shaped in accordance with a shape of a dingy to be supported by the chock, and wherein the chock includes at least one aperture or hole defined therein for enabling air to be selectively pumped into or let out of the chock.

3. The structure of claim 1, wherein said chock when in an inflated state includes a base wall, first and second end walls, and said approximately V-shaped or U-shaped channel defined in an upper surface of the chock.

4. The structure of claim 3, wherein said channel is defined by at least two angled walls of the chock, each of the two angled walls forming an angle of from about 20–50° with the horizontal.

5. A method of supporting a dingy on a surface of a boat, the method comprising:

providing a dingy to be supported;

providing a boat;

inflating at least one dingy chock;

mounting the dingy chock on the surface of the boat; and mounting the dingy on at least an upper surface of the inflated chock so that the chock helps support the dingy on the boat so that substantially an area extending all the way across a bottom surface of the boat is supported by the at least one dingy chock.

6. The method of claim 5, further comprising:

removing the dingy from the chock;

deflating the chock and storing the chock in a deflated manner when the dingy is not on the boat and is being used.

* * * * *